US005642642A

United States Patent [19]

Kawano

[11] Patent Number: 5,642,642

[45] **Date of Patent: *Jul. 1, 1997**

[54] UPPER TOOL AND UPPER TOOL HOLDING DEVICE FOR PRESS BRAKE

[75] Inventor: Susumu Kawano, Kanagawa, Japan

[73] Assignee: Amada Metrecs Company, Limited, Kanagawa, Japan

[ * ] Notice: The portion of the term of this patent subsequent to Jun. 17, 2014, has been disclaimed.

[21] Appl. No.: 544,655

[22] Filed: Oct. 18, 1995

Related U.S. Application Data

[63] Continuation of Ser. No. 239,323, May 6, 1994, Pat. No. 5,513,514.

[51] Int. Cl.[6] ..... B21D 37/04

[52] U.S. Cl. ..... 72/482.91; 72/389.3; 72/462

[58] Field of Search ..... 72/481.1, 481.3, 72/481.6, 481.9, 482.2, 482.3, 482.6, 482.91, 389, 462

[56] References Cited

U.S. PATENT DOCUMENTS

| | | | |
|---|---|---|---|
| 4,534,203 | 8/1985 | Cros . | |
| 4,993,255 | 2/1991 | Treillet . | |
| 5,022,256 | 6/1991 | van der Muelen . | |
| 5,065,610 | 11/1991 | Yonezawa . | |
| 5,245,854 | 9/1993 | Bruggink et al. . | |
| 5,507,170 | 4/1996 | Kawano | 72/482.91 |
| 5,511,407 | 4/1996 | Kawano | 72/482.91 |
| 5,513,514 | 5/1996 | Kawano | 72/482.91 |

FOREIGN PATENT DOCUMENTS

| | | |
|---|---|---|
| 0387121 | 9/1990 | European Pat. Off. . |
| 0446810 | 9/1991 | European Pat. Off. . |
| 0569880 | 11/1993 | European Pat. Off. . |
| 2540756 | 8/1984 | France . |
| 2598946 | 11/1987 | France . |
| 2609909 | 7/1988 | France . |
| 2691652 | 12/1993 | France . |
| 749638 | 11/1944 | Germany . |
| 3136440 | 3/1983 | Germany . |
| 4115224 | 11/1992 | Germany . |
| 57-199523 | 12/1982 | Japan . |
| 59-042124 | 3/1984 | Japan . |
| 62-54524 | 3/1987 | Japan . |
| 62-267019 | 11/1987 | Japan . |
| 5-317973 | 12/1993 | Japan . |
| 5-317974 | 12/1993 | Japan . |
| 5-337553 | 12/1993 | Japan . |

OTHER PUBLICATIONS

Patent Abstracts of Japan, vol. 18, No. 168 (M1580) of Mar. 22, 1994 and JP No. 05–0337553.

Japanese Patent Abstract, vol. 12, No. 145 (M693).

English Language Abstract of JP 62–267019.

European Search Reports and Annexes.

Patent Abstracts of Japan, vol. 18, No. 227 (M–1597) of Apr. 25, 1994 and JP No. 06–023436.

Patent Abstracts of Japan, vol. 8, No. 146 (M–307) of Jul. 7, 1984 and Japanese Patent Document No. 59–042124.

*Primary Examiner*—David Jones

*Attorney, Agent, or Firm*—Greenblum & Bernstein P.L.C.

[57] ABSTRACT

An upper tool for a press brake is removably attachable to an upper tool holding device mounted on an upper table of the press brake. The upper tool includes a mounting portion and a projection portion, both adjacent a first end of the upper tool, a work processing portion adjacent a second end of the upper tool, a clamping surface and a sliding surface, extending divergingly from the projection portion, and a contact surface extending substantially perpendicular to the sliding surface. The clamping surface extends along the length of the upper tool beyond the contact surface.

12 Claims, 5 Drawing Sheets

UPPER TOOL AND UPPER TOOL HOLDING DEVICE FOR PRESS BRAKE

This application is a continuation, of application Ser. No. 08/239,323, filed May 6, 1994, now U.S. Pat. No. 5,513,514.

BACKGROUND OF THE INVENTION

1. Field of the Invention

The present invention relates to an upper tool and an upper tool holding device for holding the upper tool, both for a press brake, and more specifically to an upper tool and upper tool holding device for a press brake by which the upper tool can be easily exchanged for the upper table.

2. Description of the Prior Art

As is well known, a press brake is provided with an upper table (referred to as an upper apron, sometimes) and a lower table (referred to as a lower apron, sometimes) arranged in such a way as to be opposed to each other, and either of the upper or lower table is disposed movably in the vertical direction.

To bend a plate like workpiece for instance, an upper tool is mounted on the lower part of the upper table, and a lower tool is mounted on the upper part of the lower table. Therefore, when the movable side table is moved up and down so that the upper and lower tools can be engaged with each other, a workpiece positioned between the upper and lower tools is to be bent.

Further, in the above-mentioned press brake, a number of upper tool holders are mounted on the lower part of the upper table to exchange the upper tool with an appropriate one according to the bending shape of the workpiece. In other words, the upper tools are supported by a number of upper holders so as to be exchanged.

In the prior art upper tool holder, the structure is such that an upper-tool pressing-down and fixing member is mounted on a holder body attached to the lower part of the upper table, and the upper-tool pressing-down and fixing member is fastened with fastening bolts to tightly fasten and fix the upper part of the upper tool between the holder body and the upper tool clamp.

Therefore, when the upper tool is required to be exchanged with another one, since a number of fastening bolts provided for a number of upper tool holders must be loosened, there exists a problem in that the exchanging work of the upper toot is extremely complicated and therefore troublesome.

To overcome the above-mentioned problem, a structure such that air cylinders are mounted on the upper tool holders to fasten and loosen the upper-tool pressing-down and fixing members has been developed.

In the above-mentioned structure, however, since an air cylinder must be provided for each of a number of the upper tool holders and additionally an air source is required there raises another problem in that the structure is further complicated and therefore costly.

Further, in the prior art structure, there exists such a danger that when the pressing-down and fixing of the upper tool by means of the upper-tool pressing-down and fixing member is loosened, the upper tool drops. Further, when the upper tool is mounted on the upper tool holder, the upper tool pressing-down and fixing member must be fastened tightly under the conditions that the upper-tool pressing-down and fixing member is fastened slightly to such an extent that the upper tool will not drop and thereafter the upper and lower tools are aligned with respect to each other, thus causing a problem in that the upper tool exchanging work is troublesome.

SUMMARY OF THE INVENTION

With these problems in mind, therefore, it is the first object of the present invention to provide an upper tool for a press brake which can be easily exchanged in an upper tool holder and in addition which can prevent the upper tool from being dropped even if the upper tool is released from an upper tool clamp of art upper tools holder.

The second embodiment of the present invention is to provide an upper holding device by which the upper tool can be exchanged easily.

To achieve the first object, an upper tool for a press brake, removably attached on an upper tool holding device mounted on an upper table of the press brake according to the present invention comprises: a wedge portion having a contact surface brought into contact with a lower surface of a support plate provided on a holder body of the upper tool holding device, a slide surface slidably brought into contact with any of front and rear surfaces of the support plate, and a clamp surface brought into pressure contact with a pressing-down and fixing section of an upper tool clamp of the upper tool holding device; and a work processing portion for processing a workpiece in cooperation with a lower tool.

Further, to achieve the second object, an upper tool holding device for a press brake, for removably mounting and supporting an upper tool on an upper table of the press brake according to the present invention comprises: a holder body attached to the upper table; a support plate provided on a lower portion of said holder body; an upper-tool pressing-down and fixing member attached to said holder body, for fixedly fastening an upper portion of an upper tool in cooperation with said support plate; a clamp force adjusting device for adjusting clamping force of said upper-tool pressing-down and fixing member; and a clamp releasing device for releasing the clamped upper tool.

DETAILED DESCRIPTION OF THE PREFERRED EMBODIMENTS

The embodiments of the present invention will be described hereinbelow with reference to the attached drawings.

Figure 1:
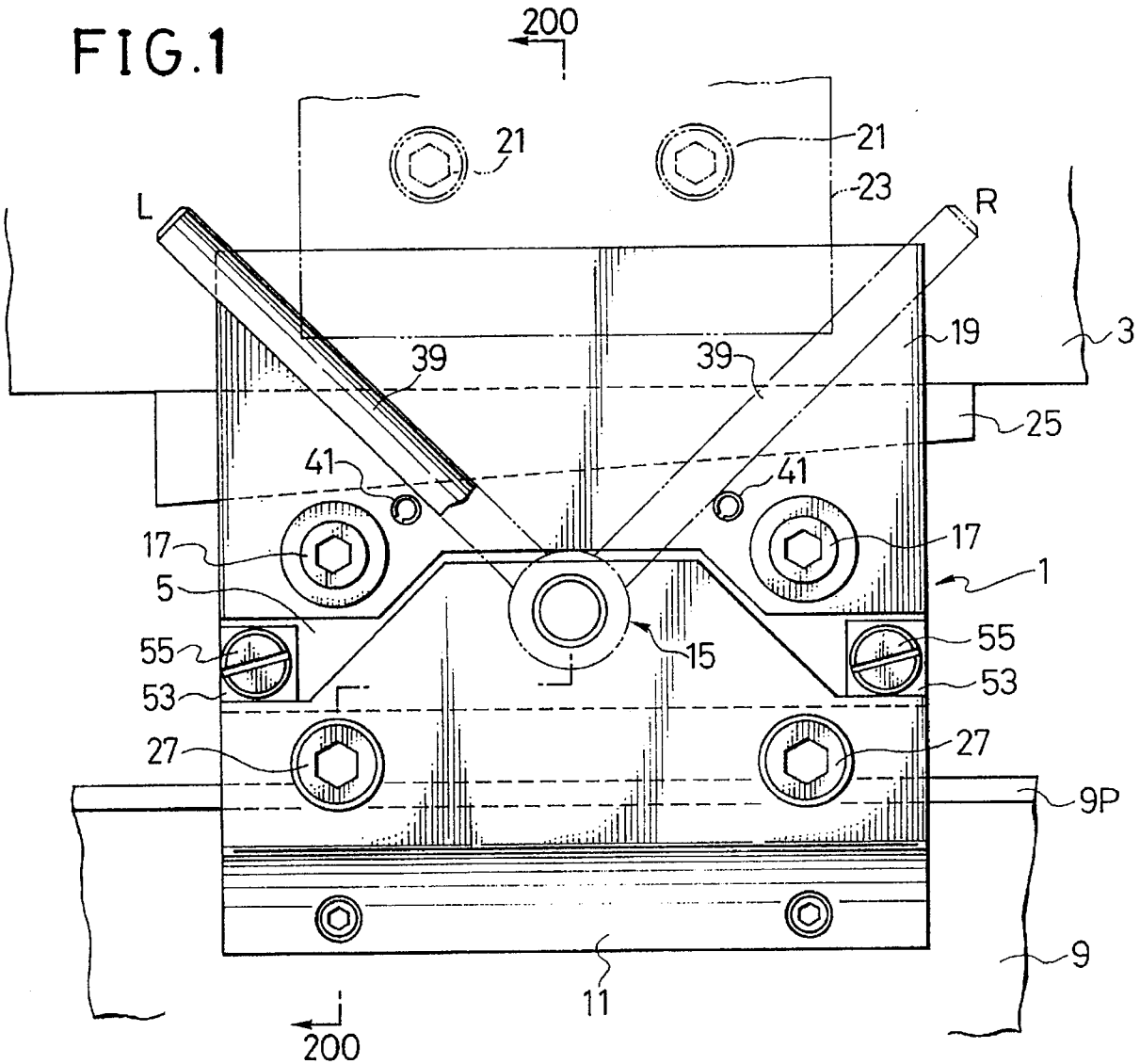
FIG. 1 is a front view showing a first embodiment of the upper holding device of the present invention.
Figure 2:
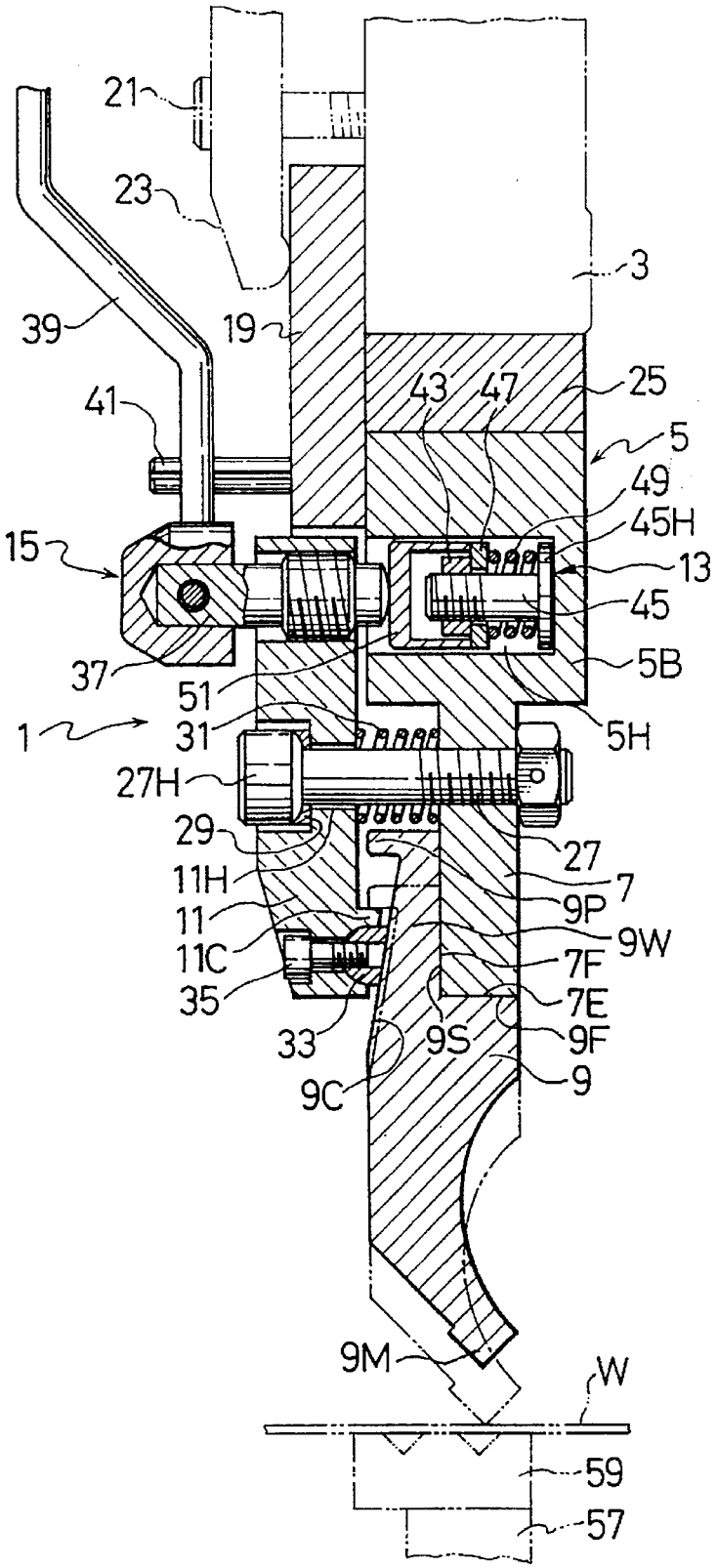
FIG. 2 is a cross-sectional view taken along the lines 200—200 shown in FIG. 1.

In FIGS. 1 and 2, the upper holding device related to the first embodiment includes a holder body 5 removably mounted on the lower part of an upper table 3 of a press brake (not shown); a support plate 7 formed integral with the lower part of the holder body 5; an upper-tool pressing-down and fixing member 11 for pressing-down and fixing an upper tool 9 between the upper-tool pressing-down and fixing member 11 and the support plate 7; a clamping-force producing device 13 for producing the clamping force of the upper-tool pressing-down and fixing member 11, and a clamp releasing device 15 for releasing the upper tool 9 from the upper-tool pressing-down and fixing member 11.

In more detail, the holder body 5 is formed with an upper block portion 5B having a thick wall in the front and rear direction (in the right and left direction in FIG. 2). The support plate 7 is formed integral with the lower part of the upper block portion 5B. To the front surface (on the left side in FIG. 2) of the upper block portion 5B of the holder body 5, a mounting plate 19 projecting upward is mounted with the use of a plurality of bolts 17 (see FIG. 1).

The holder body 5 can be mounted on the upper table 3 by bringing the mounting plate 19 into contact with the front lower portion of the upper table 3 and by fastening a clamp jaw 23 with the use of fastening bolts 21 screwed into the upper table 3.

A wedge member 25 is interposed between the upper surface of the holder body 5 and the upper table 3 to adjust the vertical position of the holder body 5.

In the structure as described above, under the condition that the clamp jaw 23 is slightly fastened against the mounting plate 19 to such an extent that the holder body 5 will not drop, it is possible to adjust the vertical position of the holder body 5 finely in the downward direction by striking the wedge member 25 slightly.

The upper-tool pressing-down and fixing member 11 is formed with a plate-shaped member having a width roughly the same as that of the holder body 5 in the right and left direction in FIG. 1, and pivotally supported by the holder body 5 so as to fix the upper tool 9 in cooperation with the support plate 7.

In more detail, the upper-tool pressing-down and fixing member 11 is formed with through holes 11H at roughly the middle portion (in the vertical direction) thereof (see FIG. 2), and pivotally supported by a plurality of mounting bolts 27 passed through the through holes 27H and screwed in the horizontal direction into the support plate 7. To facilitate the pivotal motion thereof, a spherical washer 29 is interposed between a head portion 27H of each of the mounting bolts 27 and the upper-tool pressing-down and fixing member 11. In addition, a weak coil spring 31 is elastically disposed between the upper-tool pressing-down and fixing member 11 and the support plate 7 so that the two members 11 and 7 are urged to be away form each other.

On the lower portion of the upper-tool pressing-down and fixing member 11, two pressing-down and fixing sections 11C are projectingly formed to press the upper tool 9 against the support plate 7 for clamping the upper tool 9. In addition, a push member 33 for pressing the upper tool 9 is mounted on the pressing-down and fixing section 11C with a bolt 35.

The clamp releasing device 15 is provided on the upper portion of the upper-tool pressing-down and fixing member 11 to release the upper tool 9 clamped by the pressing-down and fixing section 11C of the upper-tool pressing-down and fixing member 11.

The clamp releasing device 15 includes a fastening screw 37 screwed into the upper portion of the upper-tool pressing-down and fixing member 11, and a lever 39 is attached to this fastening screw 37.

Accordingly, when the lever 39 is pivoted, it is possible to fasten and unfasten the fastening screw 37. Further, to limit the operational (pivotal) range of the lever 39, two right and left limit pins 41 are implanted on the mounting plate 19.

The clamping-force producing device 13 includes an adjust screw 45 engaged with a nut member 43 for relative positional adjustment, a ring member 47 fitted to the adjust screw 45 so as to be movable in the axial direction, a strong elastic member 49 (a coil spring or a disk spring or urethane rubber) elastically interposed between the head portion 45H of the adjust screw 45 and the ring member 47, as shown in FIG. 2. The clamping-force producing device 13 is disposed in a horizontal inner hollow portion 6H formed in the upper block portion 5B of the holder body 5.

In the above-mentioned structure, it is possible to adjust the elastic force (the compressive condition) of the elastic member 49 by adjusting the engage position between the adjust screw 46 and the nut member 43.

Further, a contact member 61 in contact with the front end portion of the fastening screw 37 is formed integral with the ring member 47. A head portion 45H of the adjust screw 45 is in contact with the side wall of the hollow portion 5H.

In the structure as described above, under the condition that the upper tool 9 is clamped between the support plate 7 of the holder body 5 and the upper-tool pressing-down and fixing member 11 as shown in FIG. 2, when the lever 39 of the clamp releasing device 15 is pivoted clockwise to a position R in FIG. 1 to fasten the fastening screw 37, because of the elastic member 49 being further compressed, the elastic force of this elastic member 49 is further increased, so that it is possible to fasten the upper tool 9 by a still stronger fastening force.

In contrast with this, when the lever 39 is pivoted counterclockwise to a position L in FIG. 1 to unfasten the fastening screw 37, it is possible to release the fixed upper tool 9 from the fixed condition.

As described above, when the lever 39 is pivoted to fix or release the upper tool 9, the upper-tool pressing-down and fixing member 11 is pivoted in the right and left directions in FIG. 2 on the mounting bolts 27 acting as pivot centers.

As shown in FIG. 1, a plurality of small piece members 53 are attached to the holder body 5 with bolts 55 so as to be brought into contact with the upper surface of the upper-tool pressing-down and fixing member 11, in order to guide the pivotal motion of the upper-tool pressing-down and fixing member 11 and further to restrict the upward movement of the upper-tool pressing-down and fixing member 11. Accordingly, the upper-tool pressing-down and fixing member 11 can press down and fix the upper tool 9 without moving in the vertical direction.

As shown in FIG. 2, the upper tool 9 exchangeably mounted on the upper holding device 1 as described above is formed with a wedge portion 9W having a contact surface 9F brought Into contact with a lower end surface 7E of the support plate 7, a sliding surface 9S brought into slidable contact with a front surface 7F of the support plate 7, and a clamp surface 9C brought into tight contact with the push member 33 of the upper-tool pressing-down and fixing member 11.

The wedge portion 9W is so formed as to provide a thin walled portion in the upward direction by forming the clamp surface 9C as an inclined surface. Further, the wedge portion 9W is formed with a projection portion 9P engageable with the pressing-down and fixing section 11C of the upper-tool pressing-down and fixing member 11.

Further the upper tool 9 is formed with a lower end work processing portion 9M for bending a workpiece W in cooperation with a lower tool 59 mounted on a lower table 57 of the press brake.

In the structure as described above, the upper tool 9 is mounted on the upper tool holding device 1 in accordance with the following procedure:

First, the lever 39 of the clamp releasing device 15 is pivoted in the clockwise direction to hold the fastening screw 37 in the fastened condition. Even under the condition that the fastening screw 37 is fastened as described above, the push member 33 formed at the lower portion of the upper-tool pressing-down and fixing member 11 is kept away from the support plate 7.

Accordingly, as shown by phantom lines in FIG. 2, it is possible to insert the upper thin walled portion of the wedge portion 9W of the upper tool 9 into between the support plate 7 and the upper-tool pressing-down and fixing member 11 in the horizontal direction so that an upper projection portion 9P of the upper tool 9 is engaged with the pressing-down and fixing section 11C of the upper-tool pressing-down and fixing member 11.

Thereafter, the movable side of the upper or lower table 3 or 57 is moved up and down to engage the upper tool 9 with the lower tool 59, with the result that the upper tool 9 is moved upward relative to the holder body 5.

When the upper tool 9 is relatively moved gradually toward the holder body 5, because of the push member 33 of the upper-tool pressing-down and fixing member 11 being pushed toward the left in FIG. 2 by the inclined clamp surface 9C of the upper tool 9, the upper-tool pressing-down and fixing member 11 is pivoted In the clockwise direction in FIG. 2, so that the elastic member 49 of the clamp force adjusting device 13 is compressed gradually.

Accordingly, when the contact surface 9F of the upper tool 9 is brought into contact with the lower end surface 7E of the support plate 7, it is possible to obtain such a condition that the wedge portion 9W of the upper tool 9 is fastened and fixed strongly by the upper-tool pressing-down and fixing member 11 which is urged in the counterclockwise direction by the elastic force of the elastic member 49. Therefore, it is possible to easily mount the upper tool 9 on the upper tool holding device 1.

The upper tool 9 can be removed from the upper tool holding device 1 as follows:

First, the lever 39 of the clamp releasing device 15 is pivoted in the counterclockwise direction to loosen the fastening force of the fastening screw 37, so that the upper tool 9 is released from the upper-tool pressing-down and fixing member 11. When the fastened condition of the upper tool 9 is released and therefore the upper tool 9 is moved downward by its weight, the projection 9P of the wedge portion 9W of the upper tool 9 is engaged with the clamp portion 11C of the upper-tool pressing-down and fixing member 11, so that it is possible to prevent the upper tool 9 from being dropped.

As described above, under the condition that the upper tool 9 is released from the fastening or fixed condition, when the upper tool 9 is moved in the horizontal direction, it is possible to easily remove the upper tool 9 from the upper tool holding device 1.

In other words, in the embodiment according to the present invention, it is possible to easily exchange the upper tool 9 clamped by the upper holding device 1 with another upper tool, in spite of such a simple structure as described above, without use of any tools.

Figure 3:
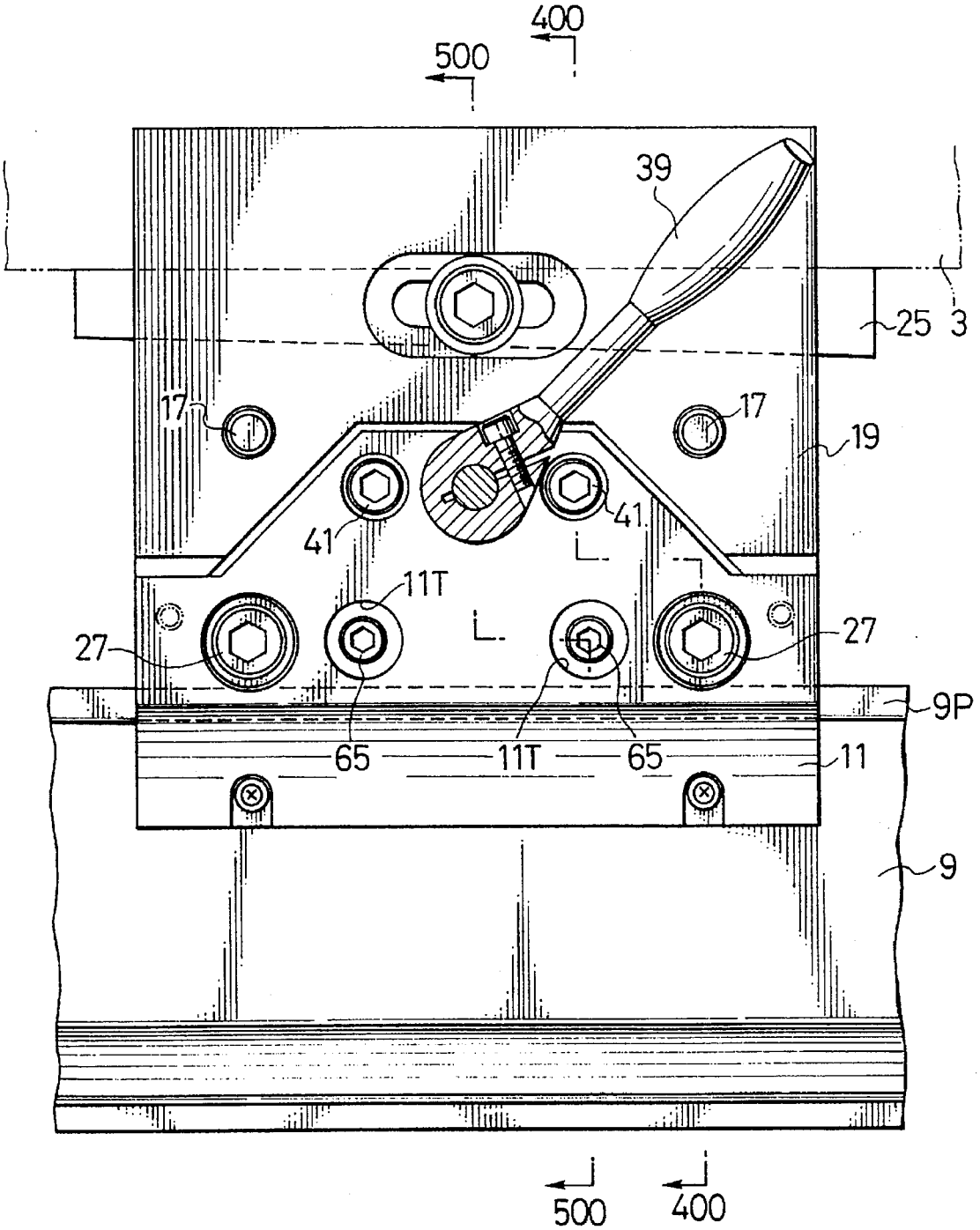
FIG. 3 is a front view showing a second embodiment of the upper holding device of the present invention.
Figure 4:
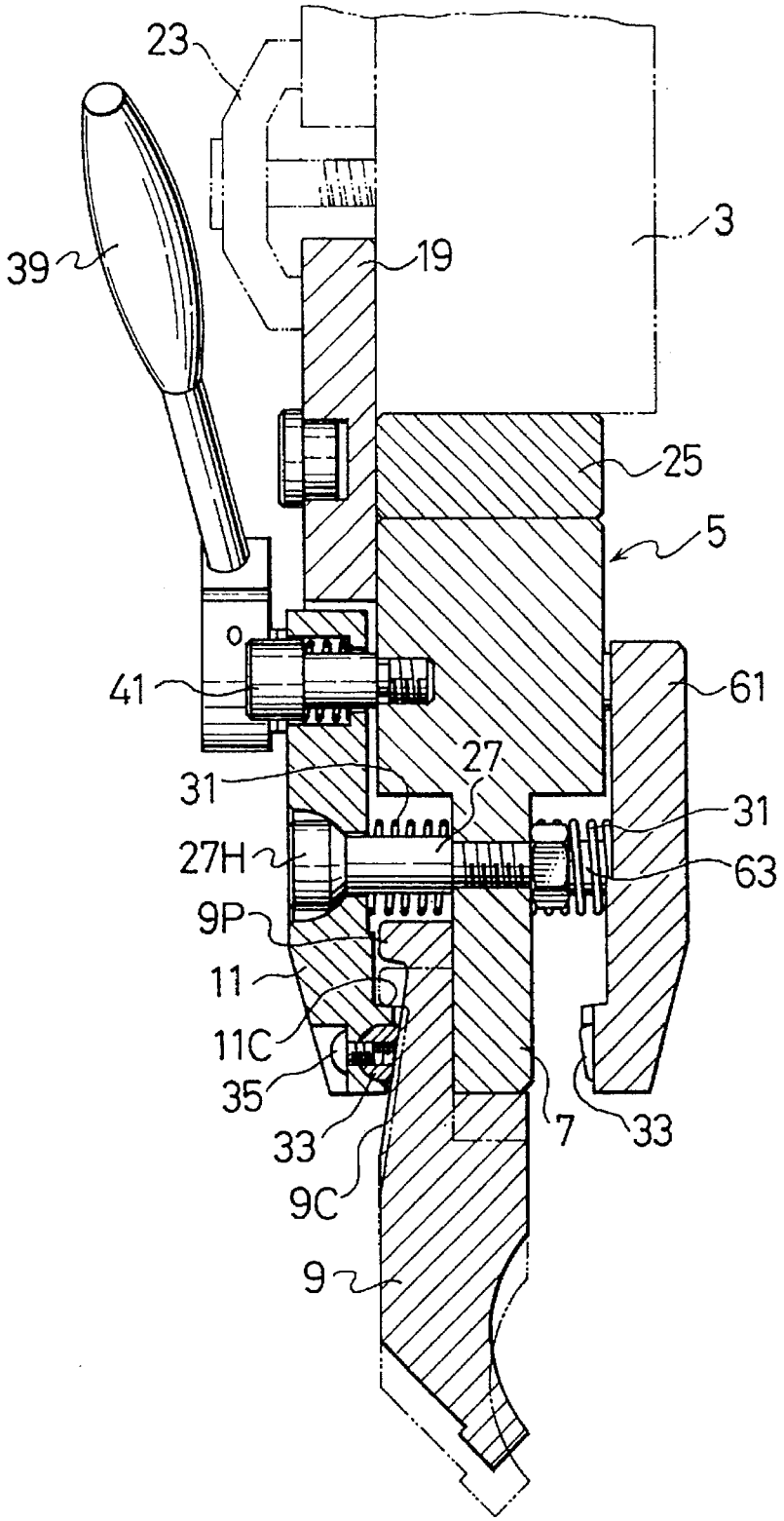
FIG. 4 is a cross-sectional view taken along the line 400 to 400 shown in FIG. 3.

A second embodiment of the upper tool holding device 1 according to the present invention will be described hereinbelow with reference to FIGS. 3 to 5. In this second embodiment, another upper tool 9 can be further clamped on the rear surface of the support plate 7.

Therefore, the same reference numerals have been retained for the similar element or parts which have the same functions as with the case of the first embodiment, without repeating any detailed description thereof, and only the points different from the first embodiment will be explained hereinbelow.

A point different from the first embodiment is that a rear-side upper-tool pressing-down and fixing member 61 is attached to the rear surface of the support plate 7 in order to clamp the other upper tool 9 on the rear surface of the support plate 7.

Figure 5:
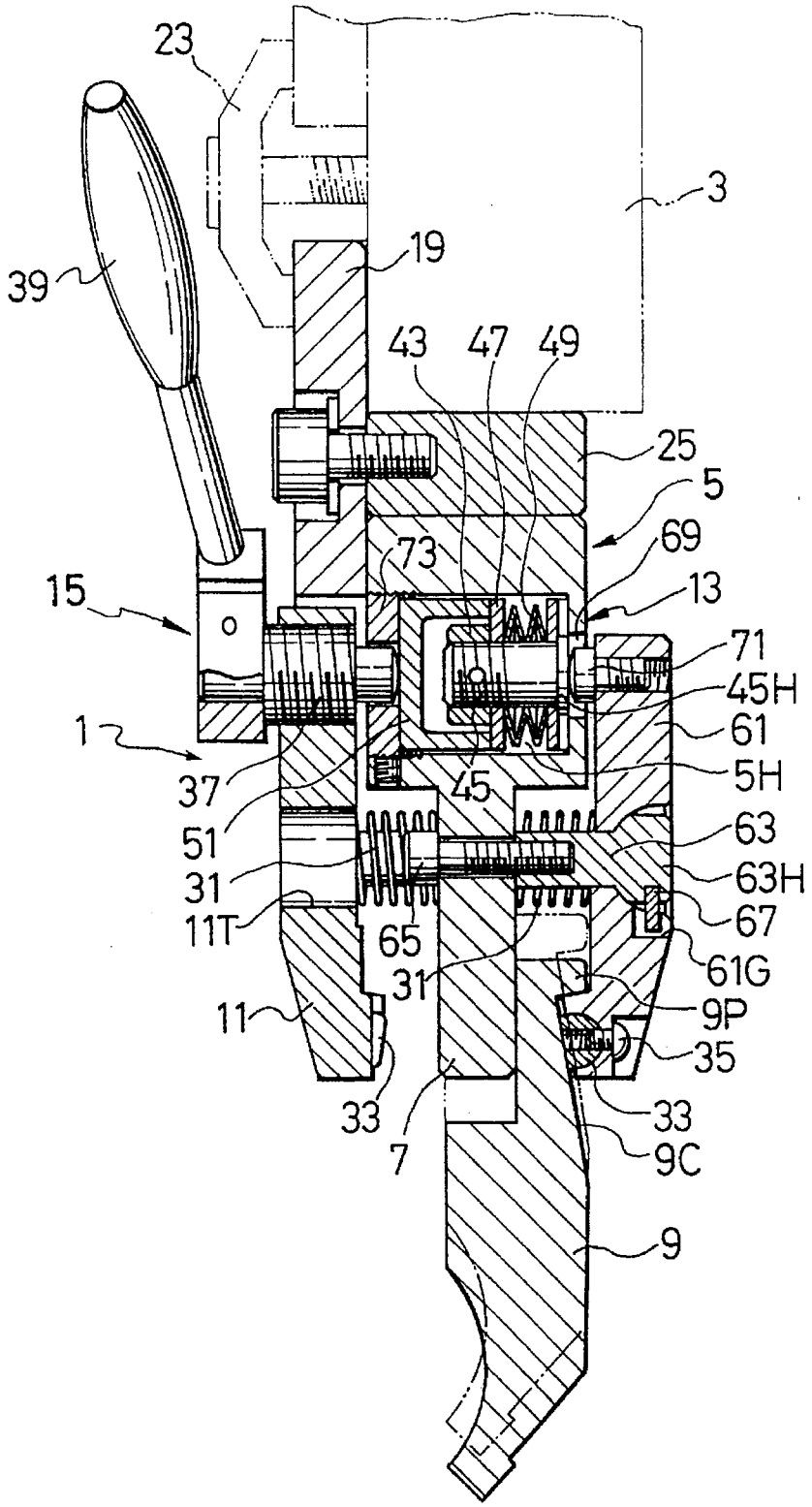
FIG. 5 is a cross-sectional view taken along the line 500—500 shown in FIG. 3, in which an upper tool is mounted on the rear side.

In more detail, in FIG. 5, a stud 63 formed with a semispherical head portion 63H is attached horizontally to the rear surface of the support plate 7 of the holder body 5 with the use of a mounting bolt 65. The rear-side upper-tool pressing-down and fixing member 61 is pivotally supported by this stud 63.

To mount the stud 65, the front side upper-tool pressing-down and fixing member 11 is formed with a tool hole 11T, and a locking pin 67 engaged with a groove 61G formed in the rear-side upper-tool pressing-down and fixing member 61 is attached to the head portion 63H of the stud 63. Accordingly, when the mounting bolt 65 is rotated, the stud 63 will not be rotated.

In order to use the clamping-force producing device 13 in common for both the front-side upper-tool pressing-down and fixing member 11 and the rear-side upper-tool pressing-down and fixing member 61, the clamping-force producing device is housed in the holder body 5, and a small diameter hole 69 is formed in the rear wall of an inner hollow portion 5H. Further, a contact member 71 mounted on the upper portion of the rear-side upper-tool pressing-down and fixing member 61 is passed through the small diameter hole 68 so as to be brought into contact with a head portion 45H of an adjust screw 45.

Further, a ring nut 73 is screwed into left side (in FIG. 5) of the inner hollow portion 5H in order to restrict the movement of the contact member 51 of the clamp adjusting device 13.

In the second embodiment as described above, when the mounting bolt 65 is fastened, it is possible to tightly fasten the upper tool 9 between the rear side of the support plate 7 and the rear-side upper-tool pressing-down and fixing member 61. When the mounting bolt 65 is loosened, the upper tool 9 can be released from the fastened condition by the rear-side upper-tool pressing-down and fixing member Further, In the case where the front-side upper-tool pressing-down and fixing member 11 is kept under the condition that an appropriate member is sandwiched between the support plate 7 and the lower end of the front-side upper-tool pressing-down and fixing member 11 (to hold the front-side upper-tool pressing-down and fixing member 11 at a fixed condition relative to the support plate 7), it is possible to fasten and release the upper tool 9 by use of the rear-side upper-tool pressing-down and fixing member 61 by operating the lever 39.

Therefore, in this second embodiment, two upper tools 9 can be fixed (both sides of each upper tool 9 are reversed) to the front and rear side surfaces of the support plate 7 of the holder body 5 according to the bending shape of the workpiece W, and in addition it is possible to exchange the upper tools 9 easily in the same way as with the case of the first embodiment.

As understood by the above-mentioned embodiments, in the upper tool holding device 1 according to the present invention, an upper tool or upper tools 9 can be exchanged easily in spite of the simple structure, and in addition it is possible to prevent the upper tool 9 from being dropped even when the upper tool holding device 1 is released from the fixed upper tool 9, thus improving the safety of the press brake.

What is claimed is:

1. An upper tool for a press brake, said upper tool for attaching to an upper tool holding device mounted on an upper table of the press brake, said upper tool comprising:

a mounting portion, said mounting portion positioned adjacent a first end of said upper tool;

a work processing portion, said work processing portion positioned adjacent a second end of said upper tool;

a projection portion, said projection portion positioned at said first end;

a clamping surface;

a sliding surface, said clamping surface and said sliding surface extending from said first end and divergingly away from each other toward said second end; and a contact surface, said contact surface extending substantially perpendicular with respect to said sliding surface and coupled to an end of said sliding surface between said first and second ends;

wherein said clamping surface extends along a length of said upper tool beyond said contact surface.

2. The upper tool according to claim 1, said projection portion extending substantially parallel to said contact surface.

3. The upper tool according to claim 1, said clamping surface comprising moving means for moving a pressing down and fixing section of the upper tool holding device away from said sliding surface.

4. The upper tool according to claim 1, said contact surface comprising means for seating said upper tool in the upper tool holding device.

5. The upper tool according to claim 1, said sliding surface comprising means for enabling linear adjustment of said upper tool in the upper holding device.

6. The upper tool according to claim 1, said clamping surface being longer than said sliding surface.

7. An upper tool for a press brake, said upper tool for attaching to an upper tool holding device mounted on an upper table of the press brake, said upper tool comprising:

a mounting portion, said mounting portion positioned adjacent a first end of said upper tool;

a work processing portion, said work processing portion positioned adjacent a second end of said upper tool;

a projection portion, said projection portion positioned at said first end;

a clamping surface;

a sliding surface, said clamping surface and said sliding surface extending from said projection portion and divergingly away from each other, each of said clamping and sliding surfaces extending toward said second end; and a contact surface, said contact surface extending substantially perpendicular with respect to said sliding surface and coupled to an end of said sliding surface between said first and second ends;

wherein said clamping surface is longer than said sliding surface.

8. The upper tool according to claim 7, said clamping surface comprising moving means for moving a pressing down and fixing section of the upper tool holding device away from said sliding surface.

9. The upper tool according to claim 7, said contact surface comprising means for seating said upper tool in the upper tool holding device.

10. The upper tool according to claim 7, said sliding surface comprising means for enabling linear adjustment of said upper tool in the upper holding device.

11. An upper tool for a press brake, said upper tool for attaching to an upper tool holding device mounted on an upper table of the press brake, said upper tool comprising:

a mounting portion, said mounting portion positioned adjacent a first end of said upper tool;

a work processing portion, said work processing portion positioned adjacent a second end of said upper tool;

a clamping surface;

a sliding surface, said clamping surface and said sliding surface extending from said first end toward said work processing portion and divergingly away from each other; and a contact surface, said contact surface extending substantially perpendicular with respect to said sliding surface, said contact surface adjacently coupled to the sliding surface in a middle portion positioned between said first end and said work processing portion;

wherein said clamping surface extends along a length of said upper tool beyond said contact surface.

12. An upper tool for a press brake, said upper tool for attaching to an upper tool holding device mounted on an upper table of the press brake, said upper tool comprising:

a mounting portion, said mounting portion positioned adjacent a first end of said upper tool;

a work processing portion, said work processing portion positioned adjacent a second end of said upper tool;

a clamping surface;

a sliding surface, said clamping surface and said sliding surface extending from said first end toward said work processing portion and forming an acute angle at said first end; and a contact surface, said contact surface extending substantially perpendicular with respect to said sliding surface, said contact surface adjacently coupled to said sliding surface at a position between said first end and said work processing portion.

* * * * *